US011590512B2

(12) United States Patent
Ibi et al.

(10) Patent No.: US 11,590,512 B2
(45) Date of Patent: Feb. 28, 2023

(54) MAGNETIC SEPARATING APPARATUS AND MAGNETIC SORTING METHOD

(71) Applicant: SINTOKOGIO, LTD., Nagoya (JP)

(72) Inventors: Yusuke Ibi, Toyokawa (JP); Hiroaki Suzuki, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 17/157,258

(22) Filed: Jan. 25, 2021

(65) Prior Publication Data

US 2021/0268515 A1 Sep. 2, 2021

(30) Foreign Application Priority Data

Feb. 28, 2020 (JP) ..... JP2020-032597
Nov. 18, 2020 (JP) ..... JP2020-191580

(51) Int. Cl.
*B22C 5/06* (2006.01)
*B03C 1/14* (2006.01)
(Continued)

(52) U.S. Cl.
CPC ..... *B03C 1/14* (2013.01); *B03C 1/145* (2013.01); *B03C 1/30* (2013.01); *B03C 1/26* (2013.01); *B03C 2201/20* (2013.01)

(58) Field of Classification Search
CPC ..... B03C 1/145; B03C 1/26
(Continued)

(56) References Cited

U.S. PATENT DOCUMENTS 1,318,003 A * 10/1919 Wheeler ..... B07B 13/003 209/696
1,339,300 A * 5/1920 Swart ..... B03C 1/14 209/214
(Continued)

FOREIGN PATENT DOCUMENTS

DE 202012010543 U1 * 3/2014 ..... B03C 1/14
JP S48-072791 A 10/1973
WO WO-2012111237 A1 * 8/2012 ..... B24C 11/00

OTHER PUBLICATIONS

Claudius; Peters, "Roller Separator For Ash Separation" (English Translation), Feb. 2014, worldwide.espacenet.com (Year: 2014).*
(Continued)

*Primary Examiner* — Michael McCullough
*Assistant Examiner* — Molly K Devine
(74) *Attorney, Agent, or Firm* — Oliff PLC

(57) ABSTRACT

A magnetic separating apparatus and magnetic sorting method can precisely and efficiently separate magnetic and non-magnetic material with a simple structure. The apparatus includes a granular mixture supply portion that supplies a granular mixture so as to naturally fall; a rotating drum having a part of an outer surface located on a falling path of the granular mixture, the rotating drum being rotationally driven in an opposite direction relative to the falling direction of the granular mixture; a first magnet that imparts a magnetic attractive force to a certain area defined by rotation in the opposite direction with a sorting area as a starting point; a naturally falling area to which the granular mixture that has come into contact with the rotating drum naturally falls; and a conveyed falling area to which the granular mixture naturally falls after being magnetically attracted to and conveyed by the rotating drum.

9 Claims, 6 Drawing Sheets

(51) Int. Cl.
*B03C 1/30* (2006.01)
*B03C 1/26* (2006.01)

(58) Field of Classification Search
USPC ..... 209/219, 223.2
See application file for complete search history.

(56) References Cited

U.S. PATENT DOCUMENTS

| | | | | |
|---|---|---|---|---|
| 3,856,666 | A * | 12/1974 | Yashima | B03C 1/03 209/226 |
| 5,100,280 | A * | 3/1992 | George, Jr. | B03C 1/18 198/690.1 |
| 8,056,728 | B2 * | 11/2011 | Riise | B03C 1/22 209/8 |
| 2015/0298138 | A1 * | 10/2015 | Vareika | B03C 1/14 29/401.1 |
| 2019/0143373 | A1 * | 5/2019 | Sugiura | B07B 9/00 209/39 |

OTHER PUBLICATIONS

Masatoshi, Yamamoto; "Projection Material Separation Device and Shot Processing Device" (English Translation); Aug. 23, 2012; worldwide.espacenet.com (Year: 2012).*

* cited by examiner

MAGNETIC SEPARATING APPARATUS AND MAGNETIC SORTING METHOD

TECHNICAL FIELD

The present invention relates to a magnetic separating apparatus and a magnetic sorting method.

BACKGROUND

In various manufacturing processes, granular mixtures containing magnetic bodies and non-magnetic bodies are often generated. When separating such a mixture into magnetic bodies and non-magnetic bodies, a magnetic separating apparatus is used.

There are situations in which large quantities of mixtures are processed, such as in the crushing of casting flasks after sand casting in foundries, the removal of molding sand from extracted cast products by shot blasting, and the recycling of slag generated in steelworks. For example, the removal of molding sand by shot blasting is disclosed in Patent Document 1. Patent Document 1 discloses an apparatus that separates mixtures of shot media and sand, etc. into the shot media (magnetic material) and the sand, etc. (non-magnetic material). In this apparatus, a tubular body having a magnet disposed thereinside is rotated, and a mixture is passed over the surface of this tubular body so that only the shot media are attracted by the magnet.

CITATION LIST

Patent Literature

Patent Document 1: JP S48-72791 A

SUMMARY OF INVENTION

Technical Problem

With the configuration in the magnetic separating apparatus disclosed in Patent Document 1, the shot media and the sand, etc. are sorted while falling in the same direction. Thus, there is a possibility that the sand, etc. will be entrained in the shot media on the surface of the rotating tubular body, making the removal of sand, etc. insufficient.

The present invention was made in consideration of the above-described circumstances, and the problem to be solved by the present invention is to provide a magnetic separating apparatus and a magnetic sorting method that can precisely and efficiently separate magnetic material from non-magnetic material with a simple structure.

Solution to Problem

The present invention employs the means indicated below in order to solve the above-mentioned problem.

Specifically, the present invention is a magnetic separating apparatus that separates and sorts a granular mixture containing a magnetic material and a non-magnetic material into the magnetic material and the non-magnetic material. This magnetic separating apparatus comprises a granular mixture supply portion, a rotating drum, a first magnet, a naturally falling area, and a conveyed falling area. The granular mixture supply portion supplies the granular mixture so as to naturally fall. The rotating drum has a part of an outer surface located on a path by which the granular mixture naturally falls, and is rotationally driven in an opposite direction relative to the falling direction of the granular mixture. The first magnet is supported inside the rotating drum, and imparts a magnetic attractive force to a certain area defined by rotation in the opposite direction from a starting point at a sorting area that is a location at which the path by which the granular mixture naturally falls meets the outer surface of the rotating drum. The naturally falling area is an area to which the granular mixture that has come into contact with the rotating drum naturally falls. The conveyed falling area is an area to which the granular mixture naturally falls after being magnetically attracted to and conveyed by the rotating drum.

According to this configuration, the rotation direction of the rotating drum is the opposite direction relative to the falling direction of the granular mixture. Thus, entrainment of the non-magnetic material in the magnetic material magnetically attracted to the rotating drum can be suppressed.

In an embodiment of the present invention, the first magnet is provided so as to impart the magnetic attractive force to the outer surface such that an end point of the certain area is at a vertically lower portion of the rotating drum, and the granular mixture that is magnetically attracted to the first magnet and conveyed is sorted by naturally falling into a laterally downward area of the conveyed falling area of the rotating drum, and a vertically downward area of the conveyed falling area.

According to this configuration, the granular mixture that is magnetically attracted to the first magnet and conveyed is further sorted, thereby allowing the magnetic material and the non-magnetic material to be more precisely separated.

In an embodiment of the present invention, a guide plate is provided at a position on the falling path facing the outer surface of the rotating drum.

According to this configuration, the magnetic material that collides with the rotating drum and bounces away is bounced back by the guide plate and returned to the rotating drum, thereby allowing the magnetic material recovery efficiency to be improved.

In an embodiment of the present invention, a conveying mechanism having a function of further sorting the magnetic material and the non-magnetic material is disposed in at least one of the naturally falling area and the conveyed falling area.

According to this configuration, the granular mixture that has been magnetically sorted by the rotating drum is further magnetically sorted by the conveying mechanism, thereby allowing the magnetic material and the non-magnetic material to be more precisely separated.

In an embodiment of the present invention, the conveying mechanism comprises, in the naturally falling area and the conveyed falling area, a drive mechanism including a pair of pulleys, and an endless belt looped around the pair of pulleys, wherein a second magnet is disposed inside one of the pulleys and imparts a magnetic attractive force to an outer surface of the pulley.

According to this configuration, the granular mixture that has been magnetically sorted by the rotating drum is further magnetically sorted by the conveying mechanism, thereby allowing the magnetic material and the non-magnetic material to be more precisely separated.

In an embodiment of the present invention, a wind separating apparatus is provided for pneumatically sorting, into the magnetic material and the non-magnetic material, the granular mixture that has naturally fallen into the vertically downward area of the conveyed falling area.

According to this configuration, the granular mixture that has been magnetically sorted is further pneumatically sorted, thereby allowing the separation precision of the magnetic material and the non-magnetic material to be improved.

In an embodiment of the present invention, the granular mixture is shot media and molding sand generated by removal, by shot blasting, of molding sand adhered to a cast article after casting.

According to this configuration, the magnetic separating apparatus of the present invention can be efficiently applied to the removal of molding sand, which is foreign matter.

A magnetic sorting method of the present invention, includes steps of:

allowing a granular mixture to naturally fall;

rotationally driving a rotating drum, a part of an outer surface of which is located on a path by which the granular mixture naturally falls, in an opposite direction relative to the falling direction of the granular mixture;

imparting a magnetic attractive force to a certain area defined by rotation in the opposite direction from a starting point at a sorting area that is a location at which the path by which the granular mixture naturally falls meets the outer surface of the rotating drum; and separating and sorting the granular mixture into a naturally falling area to which the granular mixture naturally falls, and a conveyed falling area to which the granular mixture naturally falls after being magnetically attracted to and conveyed by the rotating drum.

According to this method, the rotation direction of the rotating drum is the opposite direction relative to the falling direction of the granular mixture. Thus, entrainment of the non-magnetic material in the magnetic material magnetically attracted to the rotating drum can be suppressed, and foreign matter can be precisely removed.

An embodiment of the present invention includes steps of:

imparting the magnetic attractive force to the outer surface such that an end point of the certain area is at a vertically lower portion of the rotating drum; and sorting the granular mixture that is magnetically attracted to and conveyed by the rotating drum by making the granular mixture naturally fall into a laterally downward area of the conveyed falling area, which is below a side surface part of the rotating drum, and adjacent thereto, a vertically downward area of the conveyed falling area, which is below the vertically lower portion of the rotating drum.

According to this method, the granular mixture that is magnetically attracted to and conveyed by the rotating drum is further sorted, allowing the magnetic material and the non-magnetic material to be precisely separated.

In an embodiment of the present invention, the granular mixture is shot media and molding sand generated by removal, by shot blasting, of molding sand adhered to a cast article after casting.

As mentioned above, the magnetic separating apparatus and the magnetic sorting method according to the present invention can be suitably applied to the removal of molding sand, which is foreign matter.

Effects of Invention

According to the present invention, it is possible to provide a magnetic separating apparatus and a magnetic sorting method that can precisely and efficiently separate magnetic material from non-magnetic material with a simple structure.

DESCRIPTION OF EMBODIMENTS

First Embodiment

Figure 1:
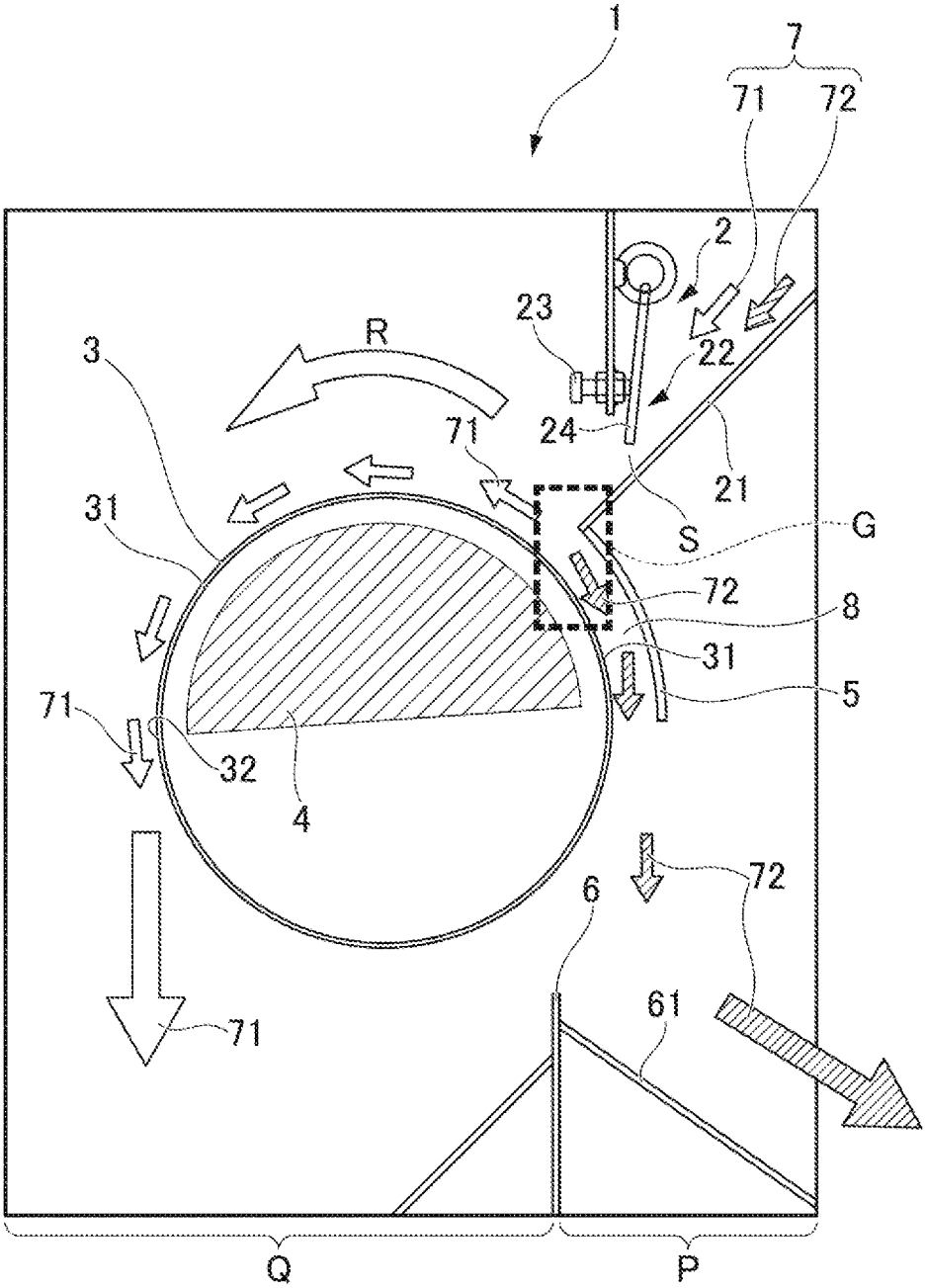
FIG. 1 is a schematic section view illustrating the structure of a magnetic separating apparatus according to an embodiment of the present invention.

Hereinafter, embodiments of the present invention will be described in detail with reference to the drawings. FIG. 1 is a schematic section view of a magnetic separating apparatus 1 according to an embodiment of the present invention. The present embodiment is for explaining the basic structure of the present invention.

As illustrated in FIG. 1, the magnetic separating apparatus 1 is provided with a granular mixture supply portion 2 (hereinafter abbreviated to supply portion 2), a rotating drum 3, a first magnet 4, a guide plate 5, and a partition plate 6.

The supply portion 2 supplies a granular mixture 7, containing shot media 71, which is a magnetic material, and foreign matter 72, which is a non-magnetic material. In the present embodiment, the foreign matter 72 is molding sand that was adhered to a cast product after casting. Therefore, the granular mixture 7 in the present embodiment is shot media 71 and molding sand (foreign matter) 72 generated by the removal, by shot blasting, of molding sand adhered to a cast article after casting. The supply portion 2 is provided with an inclined plate 21 and an adjustment gate 22, and the adjustment gate 22 is provided with an adjustment screw 23 and an adjustment plate 24. With this adjustment gate 22, the adjustment plate 24 can be moved in the left-right direction on the page surface of FIG. 1 by turning the adjustment screw 23, thereby setting the aperture of a gap S, as appropriate, to adjust the supplied amount of the granular mixture 7, including foreign matter 72 and magnetically attractable shot media 71, supplied from the supply portion 2. Hereinafter, the shot media 71 will be represented by a white arrow 71 and the foreign matter 72 will be represented by a hatched arrow, including in descriptions of the direction of flow.

The rotating drum 3 is arranged so that a portion of an outer surface 31 thereof is located in a falling path 8 of the naturally falling granular mixture 7 (71 and 72). This rotating drum 3 is rotationally driven in an opposite direction (arrow R) relative to the falling direction of the granular mixture 7. The first magnet 4 is supported inside the rotating drum 3 and is provided so as to impart a magnetic attractive force to a certain area on the outer surface 31 defined by rotation in the opposite direction R with the falling path 8 as the starting point. The partition plate 6 is disposed between a naturally falling area P, to which the granular mixture 7 is supplied and naturally falls, and a conveyed falling area Q, to which the granular mixture 7 naturally falls after being magnetically attracted to and conveyed by the rotating drum 3. The guide plate 5 is disposed at a position on the falling path 8 facing the outer surface 31 of the rotating drum.

Next, the operations in the magnetic separating apparatus in the present embodiment will be described. When the magnetic separating apparatus 1 is started, the rotating drum 3 is rotationally driven in the opposite direction (arrow R) relative to the falling direction of the granular mixture 7. During this rotation operation of the rotating drum 3, the granular mixture 7 including the shot media 71 and the foreign matter 72 is supplied to the supply portion 2. The granular mixture 7 slides down the inclined plate 21 and is supplied to a sorting area G indicated by the dashed lines contacting the rotating drum 3, the supplied amount being adjusted by the aperture of the gap S.

In the sorting area G, the foreign matter 72, which is non-magnetic material such as molding sand, naturally falls directly downward to the naturally falling area P, flows along a slope 61 of the partition plate 6, and is recovered. The shot media 71, etc., which are magnetic materials, are magnetically attracted to the rotating drum 3, on the outer surface 31 of which a magnetic attractive force is imparted by the first magnet 4. The magnetically attracted shot media 71 are conveyed by the rotating drum 3 in the direction of the arrow R. After being conveyed to a part 32 of the rotating drum 3, which is the limit to which the first magnet 4 can impart a sufficient magnetic attractive force, the shot media 71 separate from the outer surface 31 of the rotating drum 3, naturally fall to the conveyed falling area Q, and are recovered as the shot media 71.

In the present embodiment, the granular mixture 7 is supplied by naturally falling, and is magnetically sorted into the shot media 71 and the foreign matter 72 by coming into contact with the outer surface 31, to which the magnetic attractive force is imparted, in the sorting area G. Therefore, magnetic sorting instantly occurs without restricting the path of the granular mixture 7 in the sorting area G, thereby allowing the amount processed per unit time to be increased and the processing efficiency to be improved. Furthermore, the apparatus structure can be simplified by performing magnetic sorting with only one rotating drum.

Additionally, the rotating drum 3 in the present embodiment is rotationally driven in the opposite direction (arrow R) relative to the direction in which the granular mixture 7 naturally falls. When the shot media 71 are magnetically attracted to the outer surface 31 of the rotating drum 3, there are cases in which the foreign matter 72 is entrained in the shot media 71, thus remaining on the outer surface 31 of the rotating drum 3. Even if such a situation arises, the forces that are applied kinetically to the shot media 71 and the foreign matter 72 are in mutually different directions. That is, forces are applied in opposite directions to the shot media 71, which are conveyed by the rotating drum 3, and the foreign matter 72, which naturally falls due to gravity. As a result thereof, the foreign matter 72 falls out through gaps in the magnetically attracted shot media 71. Additionally, as soon as the shot media 71 come into contact with the outer surface 31 of the rotating drum, to which the magnetic attractive force is imparted, the shot media 71 are magnetically attracted and are carried in the direction opposite to gravity. That is, after being magnetically attracted, the shot media 71 are immediately conveyed away from the sorting area G, thus suppressing cases in which the shot media 71 are entrained in the natural falling of the foreign matter 72. Therefore, the precision of separation of the shot media 71 and the foreign matter 72 can be improved in comparison to cases in which the rotating drum 3 is rotated in the same direction as gravity.

Furthermore, the guide plate 5 is provided at a position on the falling path 8 facing the outer surface 31 of the rotating drum 3. Thus, the shot media 71 that collide with the outer surface 31 of the rotating drum 3 and bounce away can be bounced back by the guide plate 5 and returned to the outer surface 31 of the rotating drum 3. Therefore, the shot media 71 that have bounced away can be magnetically attracted by the rotating drum 3, and the shot media recovery efficiency can be improved.

Second Embodiment

Figure 2:
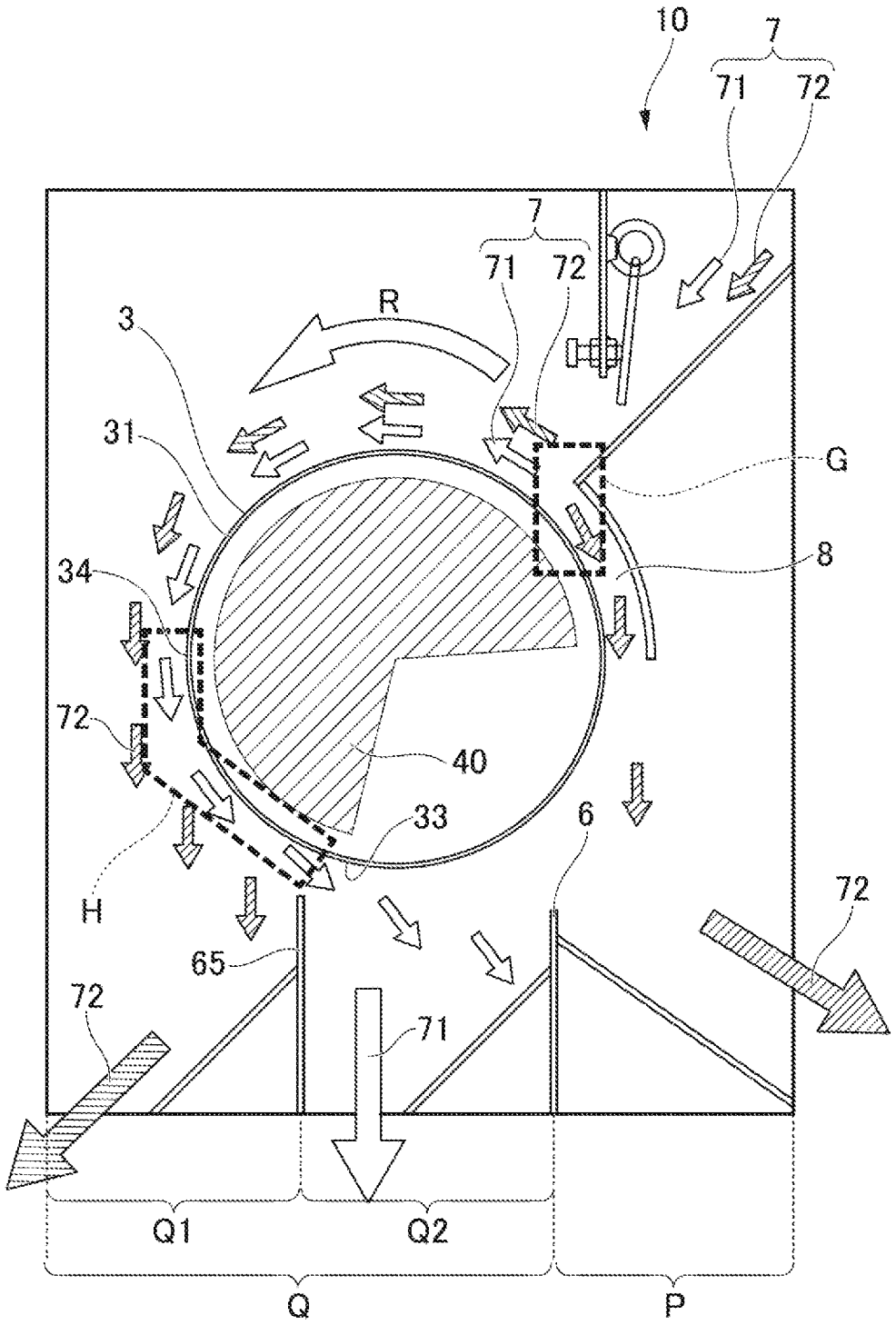
FIG. 2 is a schematic section view illustrating the structure of a magnetic separating apparatus according to an embodiment of the present invention.

Next, a second embodiment of the present invention will be described with reference to FIG. 2 and FIG. 3. FIG. 2 is a schematic section view of a magnetic separating apparatus 10 according to the present embodiment. The magnetic separating apparatus 10 in the present embodiment differs from the first embodiment in terms of the range of the magnetic attractive force imparted to the outer surface 31 of the rotating drum 3 by a first magnet 40, and in that a partition plate 65 is provided in addition to the partition plate 6. The remaining features that are the same as those in the first embodiment will be denoted by the same reference signs and the descriptions thereof will be omitted.

The first magnet 40 in the present embodiment is fixed inside the rotating drum 3 so that the end point of the area on the outer surface 31 of the rotating drum 3 to which the magnetic attractive force is imparted lies on a vertically lower portion 33 of the rotating drum 3. Furthermore, in addition to the partition plate 6, the partition plate 65 is provided in the conveyed falling area Q. The partition plate 65 is disposed between a laterally downward area Q1 of the conveyed falling area Q which is below a side surface part of the rotating drum 3, and a vertically downward area Q2 of the conveyed falling area Q which is below the vertically lower portion of the rotating drum 3.

Figure 3:
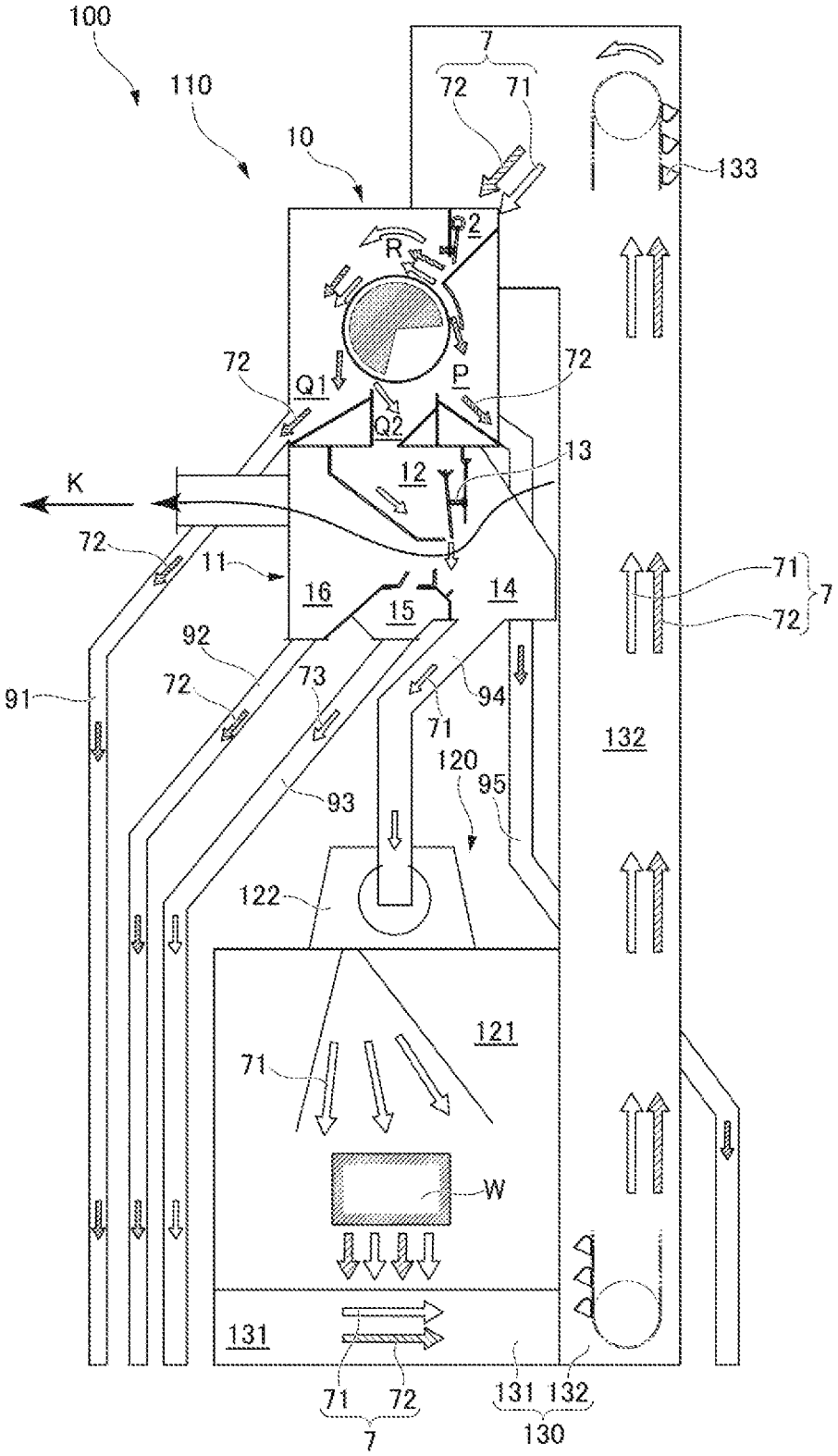
FIG. 3 is a schematic section view illustrating the structure of a shot blasting apparatus provided with a magnetic separating apparatus according to an embodiment of the present invention.

FIG. 3 is a schematic section view illustrating the structure of a shot blasting apparatus 100 provided with the magnetic separating apparatus 10 according to the present embodiment. The shot blasting apparatus 100 is provided with a separator portion 110 that separates the shot media 71 from the foreign matter 72, a shot blasting portion 120 that shot-blasts workpieces W, and a circulation portion 130 that circulates and reuses the shot media 71 in the shot blasting apparatus.

The separator portion 110 is provided with the aforementioned magnetic separating apparatus 10 and a wind separating apparatus 11. The wind separating apparatus 11 is provided with a storage portion 12 having an adjustment gate 13, a first pneumatic sorting portion 14, a second pneumatic sorting portion 15, and a third pneumatic sorting portion 16. Regarding the wind separating apparatus 11, the flow of air for pneumatic sorting is schematically indicated by the arrow K. The shot blasting portion 120 has a structure in which a projector 122 is disposed in the upper portion of a projection chamber 121. The circulation portion 130 is provided with a bucket elevator 132 having a screw conveyor 131 and a plurality of buckets 133.

When the shot blasting apparatus 100 is started, the projector 122 projects shot media 71 towards a workpiece W installed in the projection chamber 121, thereby shot-blasting a workpiece W. The projected shot media 71 and foreign matter 72, including scales and burrs generated by the shot blasting, and dust, fall to the lower portion of the projection chamber 121.

The screw conveyor 131, which is disposed in the lower portion of the projection chamber 121, conveys the granular mixture 7, including the shot media 71 and the foreign matter 72 that have fallen, to the bucket elevator 132. The bucket elevator 132 scoops up the granular mixture 7 that has been conveyed by the screw conveyor 131 and conveys it to the upper portion of the apparatus. The granular mixture 7 conveyed to the upper portion of the apparatus is hurled out into a chute (not illustrated) at the upper end of the bucket elevator 132, and is supplied to the separator portion 110.

At the separator portion 110, the shot media 71 is separated from the foreign matter 72 by the operations of the separator portion 110 to be described in detail below. The separated shot media 71 are supplied once again to the projector 122 through a hose 94, and the shot blasting is continuously performed. Non-iron-based foreign matter 72 is recovered through hoses 91, 92, and 95 and reused or discarded. The shot media 71, and shot media, etc. 73 including similarly iron-based material having less mass than the shot media 71, for example, burrs from iron-based workpieces and damaged shot media, are recovered through a hose 93 and reused as material or discarded.

Next, the operations of the magnetic separating apparatus 10 in the separator portion 110 will be described. As illustrated in FIG. 2, for the operations in the sorting area G, the structure is the same as that in the first embodiment, and thus, the description will be omitted. The difference between the operations in the first embodiment and the present embodiment lies in the fact that there is a sorting area H in addition to the sorting area G. After primary magnetic sorting is performed in the sorting area G, the granular mixture 7 including the shot media 71 magnetically attracted to the outer surface 31 of the rotating drum 3 and the non-iron-based foreign matter 72 entrained in the shot media 71 are conveyed in the direction of the arrow R to the sorting area H.

Of the granular mixture 72 that is conveyed, the foreign matter 72 that is non-iron-based and thus not magnetically attracted separates from the outer surface 31 of the rotating drum 3 from a position at the side surface part 34 of the rotating drum 3, and naturally falls to the laterally downward area Q1 of the conveyed falling area Q. After being conveyed to a part 33 of the rotating drum 3, which is the limit to which the first magnet 40 can impart a sufficient magnetic attractive force, the shot media 71 separate from the outer surface 31 of the rotating drum 3, naturally fall to the vertically downward area Q2 of the conveyed falling area Q, and are recovered as the shot media 71. In this way, secondary magnetic sorting is performed in the sorting area H.

As illustrated in FIG. 3, the area P of the magnetic separating apparatus 10 is connected to the hose 95, and the foreign matter 72 that has naturally fallen in the area P due to the primary magnetic sorting is recovered through the hose 95. The area Q1 is connected to the hose 91, and the foreign matter 72 that has naturally fallen in the area Q1 due to the secondary magnetic sorting is recovered through the hose 91. Similarly, the shot media 71 that have naturally fallen in the area Q2 due to the secondary magnetic sorting are supplied to the storage portion 12 of the wind separating apparatus 11, which is disposed below the magnetic separating apparatus 10.

The shot media 71 supplied to the storage portion 12 fall into a space below, in which they are divided between first to third pneumatic sorting portions 14, 15, and 16, the falling amount being adjusted by the adjustment gate 13. The shot media 71 that have fallen are sorted by falling into the first to third pneumatic sorting portions 14, 15, and 16 in the order, respectively, of heavier mass, due to the pneumatic pressure from air K. The first to third pneumatic sorting portions 14, 15, and 16 are respectively connected, in order, to the hoses 94, 93, and 92. The shot media 71 that have fallen into the first pneumatic sorting portion 14 are supplied to the projector 122 through the hose 94. The damaged shot media, etc. 73 that have fallen into the second pneumatic sorting portion 15 and the foreign matter 72 that has fallen into the third pneumatic sorting portion are respectively recovered, in order, through the hoses 93 and 92.

As mentioned above, the magnetic separating apparatus 10 in the present embodiment, in addition to functions and effects similar to those of the first embodiment, can improve the separation precision between the shot media 71 and the foreign matter 72 because primary magnetic sorting and secondary magnetic sorting are performed in the sorting areas G and H. Additionally, in the secondary magnetic sorting that is performed after the first magnetic sorting has been performed, the granular mixture 7 is thinly adhered to the outer surface 31 of the rotating drum 3 and the magnetic sorting precision is improved, so the overall separation precision can be improved. Since the primary magnetic sorting and the secondary magnetic sorting are performed by a single rotating drum, the separation precision can be improved with a simple structure without increasing the apparatus scale. Additionally, the structure is simple, formed by using just a single rotating drum. Thus, malfunctions can be reduced, and the labor required for daily maintenance can also be reduced. Since sufficient sorting is performed by the primary magnetic sorting and the secondary magnetic sorting, the air flow rate during the final pneumatic sorting can be reduced, and the power consumption can be decreased. Furthermore, since the separation precision is improved in the apparatus overall, the contamination of the shot media 71 returned from the circulation portion 130 to the projector 122 with foreign matter 72 can be reduced, thereby allowing the wear on consumable components in the apparatus to be suppressed and extending the apparatus lifetime.

Third Embodiment

Figure 4:
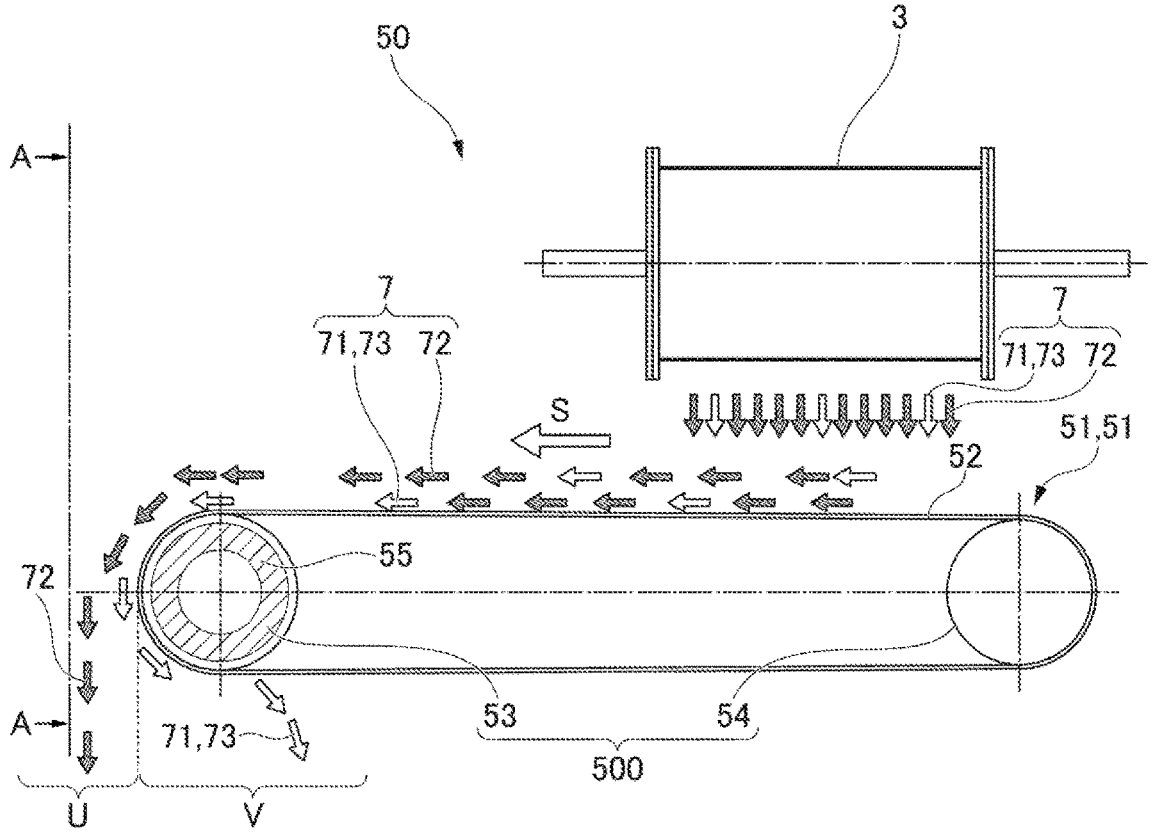
FIG. 4 is a schematic side view illustrating the structure of a magnetic separating apparatus according to an embodiment of the present invention.
Figure 5:
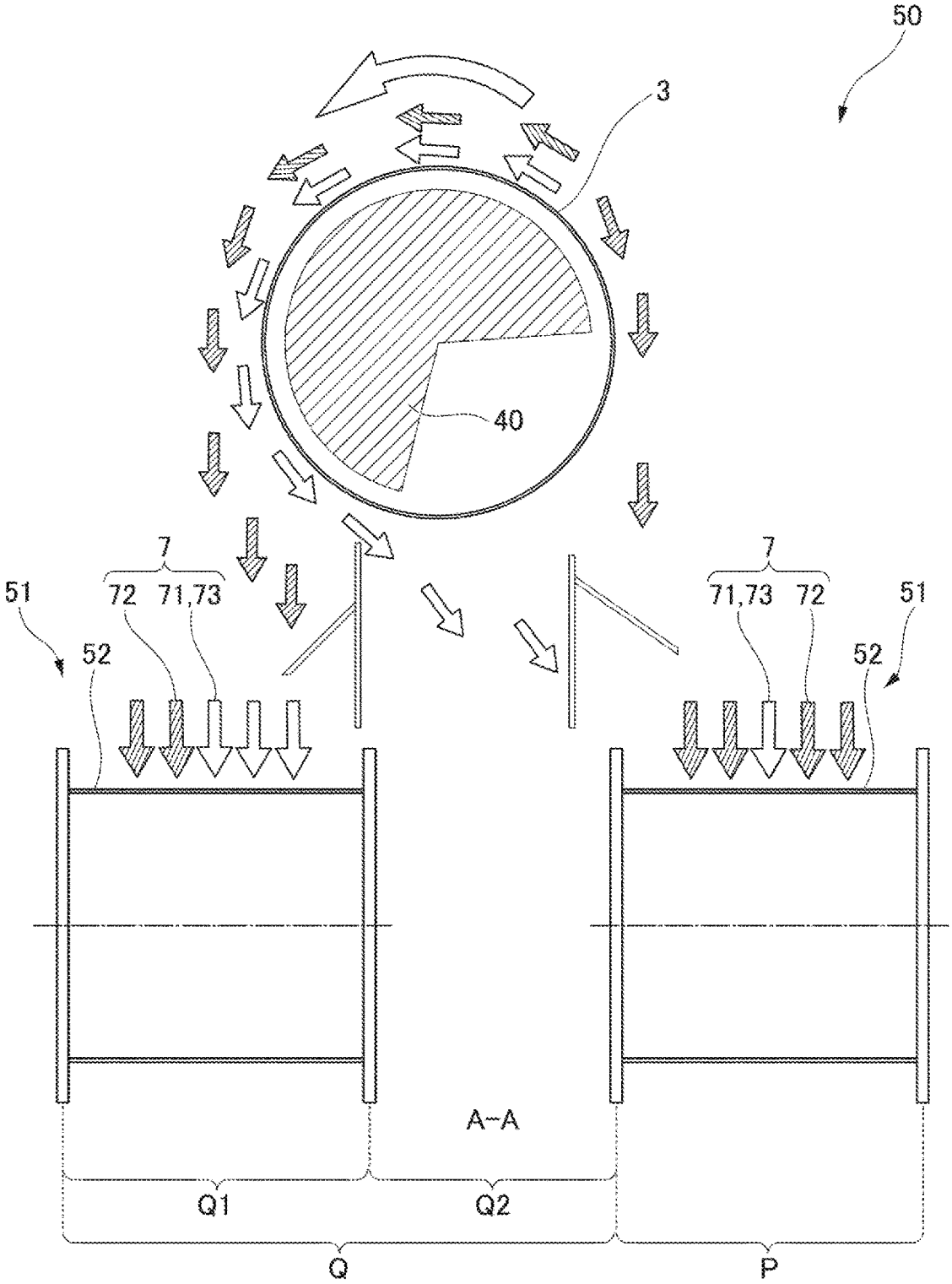
FIG. 5 is an enlarged view along the arrow A-A in FIG. 4.

Next, a third embodiment of the present invention will be described with reference to FIG. 4 and FIG. 5. FIG. 4 is a schematic side view illustrating the structure of a magnetic separating apparatus 50 according to the present embodiment, and FIG. 5 is an enlarged view along the arrow A-A in FIG. 4, corresponding to FIG. 1 for the first embodiment and FIG. 2 for the second embodiment. The magnetic separating apparatus 50 in the present embodiment differs from the magnetic separating apparatus 10 in the second embodiment in that a conveying mechanism (belt conveyor) 51 is provided in the naturally falling area P and in the laterally downward area Q1 of the conveyed falling area Q. The conveying mechanism 51 in the present embodiment has a magnetic sorting function. This belt conveyor 51 is provided with a drive mechanism 500 including a pair of pulleys 53 and 54, and an endless belt 52 looped around the pair of pulleys 53 and 54. A second magnet 55 that imparts a magnetic attractive force to an outer surface of the pulley 53 is disposed inside one pulley 53 of the pulleys 53 and 54. The remaining features that are the same as those in the second embodiment will be denoted by the same reference signs and the descriptions thereof will be omitted.

When the magnetic separating apparatus 50 is started, the foreign matter 72 sorted by the operations of the first magnet 40 naturally fall in the naturally falling area P and the laterally downward area Q1 of the conveyed falling area Q due to the same operations as those in the second embodiment. At this time, the foreign matter 72 that has naturally fallen includes a small amount of shot media 71 that was not able to be properly magnetically sorted, and damaged shot media, etc. 73, which are iron-based material. This granular mixture 7 falls onto the endless belt 52 of the belt conveyor 51 and 51 that is arranged horizontally in the naturally falling area P and the laterally downward area Q1 of the conveyed falling area Q.

The belt conveyor 51 in the present embodiment drives the endless belt 52 in the direction indicated by the arrow S in FIG. 4. As mentioned above, in the belt conveyor 51, one of the pulleys 53 of the pair of pulleys 53 and 54 has a magnet 55. Thus, of the granular mixture 7 that is conveyed, the foreign matter 72 is not magnetically attracted to the magnet 55 and thus naturally falls into an area U. The shot media 71 and the damaged shot media, etc. 73, which are iron-based materials, are magnetically attracted to the magnet 55, and thus do not fall into the area U, instead moving from the left side surface of the pulley 53 towards the lower portion, and naturally falling into an area V after being conveyed to a range not reached by the magnetic attractive force of the magnet 55. Therefore, the belt conveyor 51 sorts the granular mixture 7 into the foreign matter 72 and into the shot media 71 and damaged shot media, etc. 73 in the area U and the area V (tertiary magnetic sorting).

The magnetic separating apparatus 50 in the present embodiment, in addition to functions and effects similar to those of the second embodiment, can further improve the sorting precision by performing the tertiary magnetic sorting by means of the belt conveyor 51 and 51 arranged horizontally in the naturally falling area P and the laterally downward area Q1 of the conveyed falling area Q. Additionally, the belt conveyor 51 is arranged horizontally. Thus, the height of the magnetic separating apparatus 50 is not increased, and the magnetic separating apparatus 50 can be realized without increasing the scale thereof, even with a structure in which the belt conveyor 51 is added. Furthermore, the belt conveyor 51 can be operated in a horizontally arranged state, and thus can be easily mounted.

MODIFIED EXAMPLES

Figure 6:
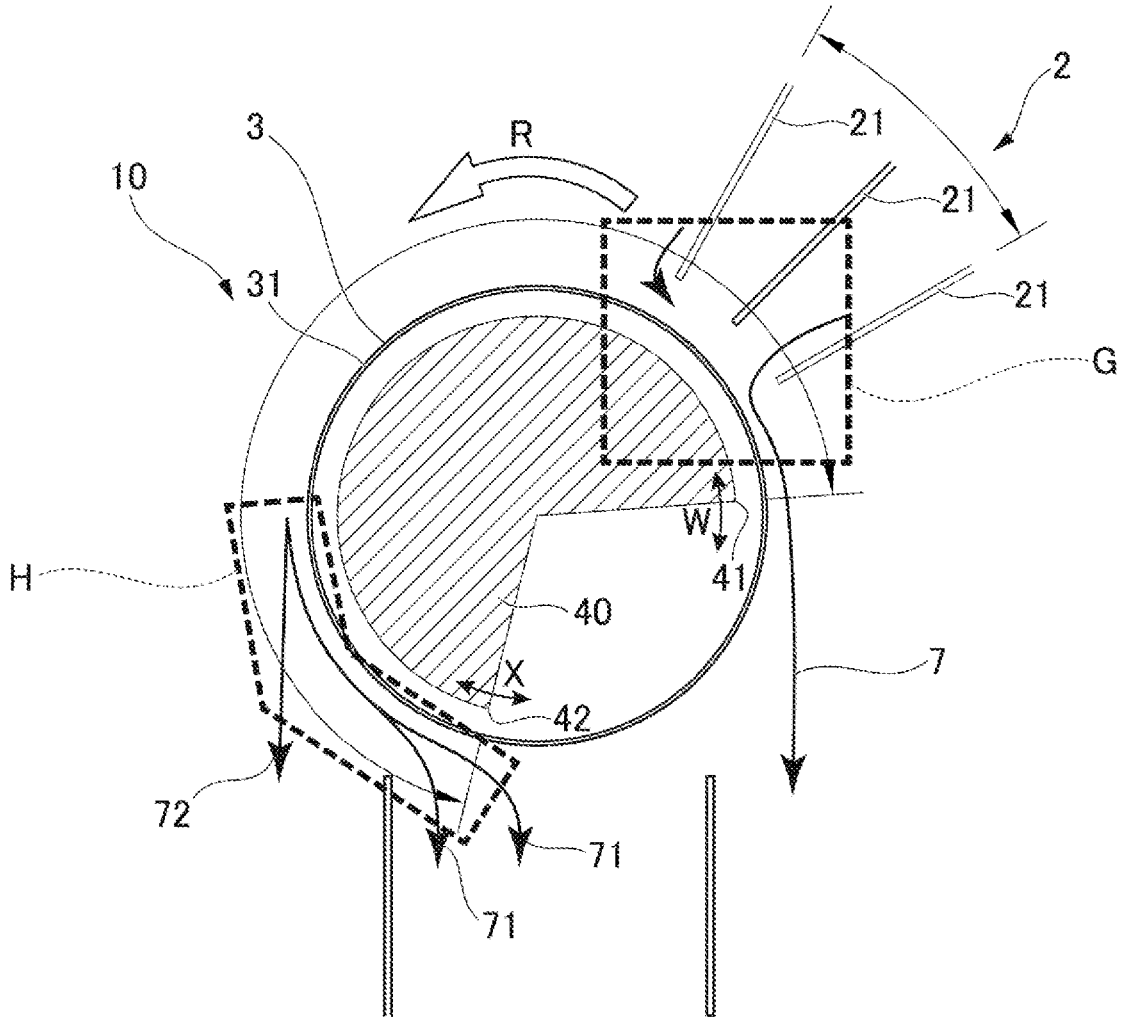
FIG. 6 is a schematic diagram illustrating the structure of a magnetic separating apparatus according to a modified example of an embodiment of the present invention.

FIG. 6 is a diagram for explaining a modified example of the above-mentioned embodiment, corresponding to FIG. 2 for the second embodiment. As illustrated in FIG. 6, the inclination angle of the inclined plate 21 in the supply portion 2 of the magnetic separating apparatus 10, the supply position of the granular mixture 7, the rotation speed of the rotating drum 3, and the range on the outer surface 31 of the rotating drum 3 to which the magnetic attractive force is imparted by the first magnet 40 can be modified in accordance with the conditions of implementation, as appropriate.

For example, by changing the angle of the inclined plate 21, the flow rate of the granular mixture 7 supplied to the rotating drum 3 can be changed. By changing the rotation speed of the rotating drum 3, the sorting precision can be adjusted. Alternatively, in FIG. 6, the magnetic attractive force is imparted to the outer surface 31 of the rotating drum 3 over a range from points 41 to 42, but this range may also be changed, as illustrated by the arrows W and X. Each of the parameters may be adjusted for optimal results in consideration of the amount to be processed by magnetic sorting, and the sorting precision.

In the above-described embodiments, the projector 122 was described as a shot blasting apparatus, but there is no limitation thereto, and the present invention may also be applied to an ejection apparatus. That is, the present invention is applicable to all cases in which a granular mixture containing a magnetic material and a non-magnetic material is to be sorted.

Additionally, in the above-described embodiments, a belt conveyor having a magnetic sorting function was described as a conveying mechanism, but there is not limitation thereto, and it is sufficient for the conveying mechanism to have a function for sorting the shot media from the foreign matter. For example, a screw conveyor or the like having a magnetic sorting function may be employed as the conveying mechanism.

In the above-described embodiments, the case in which sand and magnetic granules are to be separated from granular materials generated when molding sand is removed from products by shot blasting after casting. However, the present invention is not limited thereto. The magnetic separating apparatus of the present application can be favorably used when processing large quantities of articles to be processed. For example, it can be used to separate magnetic granules and non-magnetic granules (molding sand) from granular materials generated by crushing casting flasks (sand molds). For example, it can be used to separate magnetic materials and non-magnetic materials generated when a shot blasting apparatus has been used for blasting, such as when recycling solar panels. For example, it can be used to separate magnetic granules and non-magnetic granules after fracturing slag generated in steelworks.

REFERENCE SIGNS LIST

1, 10, 50 Magnetic separating apparatus
2 Granular mixture supply portion (supply portion)
3 Rotating drum
31 Outer surface of rotating drum
4, 40 First magnet
5 Guide plate
51 Conveying mechanism (belt conveyor)
52 Endless belt
53, 54 Pulley
55 Second magnet
500 Drive mechanism
7 Granular mixture
71 Shot media
72 Foreign matter
8 Falling path
G Sorting area
P Naturally falling area
Q Conveyed falling area
Q1 Laterally downward area of conveyed falling area
Q2 Vertically downward area of conveyed falling area
R Opposite direction relative to falling direction

The invention claimed is:

1. A magnetic separating apparatus that separates and sorts a granular mixture containing a magnetic material and a non-magnetic material into the magnetic material and the non-magnetic material, the magnetic separating apparatus comprising:

a granular mixture supply portion that supplies the granular mixture so as to naturally fall;

a rotating drum having a part of an outer surface located on a falling path that is a path by which the granular mixture naturally falls, the rotating drum being rotationally driven in an opposite direction relative to the falling direction of the granular mixture;

a first magnet supported inside the rotating drum, the first magnet imparting a magnetic attractive force to a certain area defined by rotation in the opposite direction from a starting point at a sorting area that is a location at which the path by which the granular mixture naturally falls meets the outer surface of the rotating drum;

a naturally falling area to which the granular mixture that has come into contact with the rotating drum naturally falls;

a conveyed falling area to which the granular mixture naturally falls after being magnetically attracted to and conveyed by the rotating drum; and a guide plate at a position on the falling path, the guide plate facing and being separated from the outer surface of the rotating drum, and following a contour of the rotating drum.

2. The magnetic separating apparatus according to claim 1, wherein:

the first magnet is provided so as to impart the magnetic attractive force to the outer surface such that an end point of the certain area is at a vertically lower portion of the rotating drum; and the granular mixture that is magnetically attracted to the first magnet and conveyed is sorted by naturally falling into a laterally downward area of the conveyed falling area of the rotating drum, and adjacent thereto, a vertically downward area of the conveyed falling area of the rotating drum.

3. The magnetic separating apparatus according to claim 2, provided with a wind separating apparatus for pneumatically sorting, into the magnetic material and the non-magnetic material, the granular mixture that has naturally fallen into the vertically downward area of the conveyed falling area.

4. The magnetic separating apparatus according to claim 1, wherein a conveying mechanism having a function of further sorting the magnetic material and the non-magnetic material is disposed in at least one of the naturally falling area and the conveyed falling area.

5. The magnetic separating apparatus according to claim 4, wherein the conveying mechanism comprises, in the naturally falling area and the conveyed falling area, a drive mechanism including a pair of pulleys, and an endless belt looped around the pair of pulleys, wherein a second magnet is disposed inside one of the pair of pulleys and imparts a magnetic attractive force to an outer surface of the one of the pair of pulleys.

6. The magnetic separating apparatus according to claim 1, wherein the granular mixture is shot media and molding sand generated by removal, by shot blasting, of molding sand adhered to a cast article after casting.

7. A magnetic sorting method for separating and sorting a granular mixture containing a magnetic material and a non-magnetic material into the magnetic material and the non-magnetic material, the magnetic sorting method comprising steps of:

allowing the granular mixture to naturally fall;

rotationally driving a rotating drum, a part of an outer surface of which is located on a path by which the granular mixture naturally falls, in an opposite direction relative to the falling direction of the granular mixture;

imparting a magnetic attractive force to a certain area defined by rotation in the opposite direction from a starting point at a sorting area that is a location at which the path by which the granular mixture naturally falls meets the outer surface of the rotating drum;

separating and sorting the granular mixture into a naturally falling area to which the granular mixture naturally falls, and a conveyed falling area to which the granular mixture naturally falls after being magnetically attracted to and conveyed by the rotating drum; and bouncing back and returning shot media that collide with the outer surface of the rotating drum and bounce away, to the outer surface of the rotating drum, by a guide plate at a position on the path by which the granular mixture naturally falls, the guide plate facing and being separated from the outer surface of the rotating drum, and following a contour of the rotating drum.

8. The magnetic sorting method according to claim 7, further comprising steps of:

imparting the magnetic attractive force to the outer surface such that an end point of the certain area is at a vertically lower portion of the rotating drum; and sorting the granular mixture that is magnetically attracted to and conveyed by the rotating drum by making the granular mixture naturally fall into a laterally downward area of the conveyed falling area, which is below a side surface part of the rotating drum, and adjacent thereto, a vertically downward area of the conveyed falling area, which is below the vertically lower portion of the rotating drum.

9. The magnetic sorting method according to claim 7, wherein the granular mixture is shot media and molding sand generated by removal, by shot blasting, of molding sand adhered to a cast article after casting.

* * * * *